US005437500A

United States Patent [19]

Lehmann et al.

[11] Patent Number: 5,437,500

[45] Date of Patent: Aug. 1, 1995

[54] TUNNELING MACHINE WITH CENTER CUTTER AND DEBRIS REMOVING MEANS

[75] Inventors: Gebhard Lehmann, Lahr; Rolf Heerssen, Pinneberg; Martin Herrenknecht, Schwanau, all of Germany

[73] Assignee: Herrenknecht GmbH, Schwanau, Germany

[21] Appl. No.: 137,102

[22] PCT Filed: Jan. 25, 1992

[86] PCT No.: PCT/DE92/00047

§ 371 Date: Dec. 20, 1993

§ 102(e) Date: Dec. 20, 1993

[87] PCT Pub. No.: WO92/18751

PCT Pub. Date: Oct. 29, 1992

[30] Foreign Application Priority Data

Apr. 23, 1991 [DE] Germany ..... 41 13 208.4

[51] Int. Cl.[6] ..... E21D 9/08

[52] U.S. Cl. ..... 299/60; 299/81; 299/90

[58] Field of Search ..... 299/33, 56, 58, 59, 299/60, 90, 81; 405/138

[56] References Cited

U.S. PATENT DOCUMENTS

| | | | |
|---|---|---|---|
| 2,756,037 | 7/1956 | Kirkpatrick | 299/56 |
| 2,864,599 | 12/1958 | Masoni | 299/60 X |
| 3,355,215 | 11/1967 | Haspert et al. | 299/60 |
| 4,607,889 | 8/1986 | Hagimoto et al. | 299/56 X |

FOREIGN PATENT DOCUMENTS

| | | |
|---|---|---|
| 1240911 | 5/1967 | Germany . |
| 1534612 | 8/1969 | Germany . |
| 843581 | 8/1960 | United Kingdom . |
| 81/00590 | 3/1981 | WIPO . |

*Primary Examiner*—David J. Bagnell
*Attorney, Agent, or Firm*—Baker & Daniels

[57] ABSTRACT

The invention is directed to a tunnel-driving machine designed to bore a tunnel and having, in addition to a large outer cutter wheel, a smaller central cutter wheel which is mounted near the hub of the outer cutter wheel and which enables the formation of soil plugs and dead cores to be avoided along the longitudinal axis of the cutting wheel, thus reducing the resistance of the machine to forward motion.

7 Claims, 4 Drawing Sheets

TUNNELING MACHINE WITH CENTER CUTTER AND DEBRIS REMOVING MEANS

BACKGROUND OF THE INVENTION

1. Field of the Invention

The invention concerns a tunneling machine for boring a tunnel, with a shield that can be driven into the soil and in which a cutting wheel, powered and equipped with ripping tools, is arranged.

2. Description of the Invention

Tunneling of this type are known and feature a cutting wheel with several cutting arms, where the ripped soil proceeds through the spaces in the cutting arms into the tunneling machine and is then removed. Owing to the high forces which occur, the hub area of the cutting wheel, originating from which the cutting arms extend radially outward, is of a massive and stabile design. Therefore, soil ripped in the area of the longitudinal axis of the cutting wheel needs to be moved in the radial direction of the cutting wheel up to one of the spaces between the cutting arms of the cutting wheel. Besides, since in the center area of the cutting wheel the velocity of the ripping tools contained there is lower than the velocity of the tools revolving on a larger radius, a dead core results often in the axis area of the cutting wheel, with essentially a soil displacement taking place there, instead of an active soil removal. The formation of a soil plug thus increases the forward resistance of the tunneling machine, especially in cohesive soil, such as loam and clay. To improve the escape of the soil in the dead core of the cutting wheel, slip layers have already been used. But these wear quickly, so that an initially slight forward resistance will in the course of time increase, due to the wear in the central area of the cutting wheel. The increased forward resistance with the prior tunneling machines reduces the rate of advance in tunneling and requires higher driving capacities.

The problem underlying the invention is to provide a tunneling machine which is characterized by a low forward resistance.

SUMMARY OF THE INVENTION

The present invention provides a tunneling machine including a center cutter disposed in the hub area of the cutting wheel which is rotatable relative to the cutting wheel and features as well ripping tools and a central cutting wheel.

The central cutting wheel of the center cutter makes it possible to work in the dead core area independently of the ripping with the larger cutting wheel. For that, the center cutter has for both directions of rotation a drive mechanism which is separate from the cutting wheel. To be able to remove the soil in the dead core quickly and simply, the center cutter has at least one inlet opening for the soil to be ripped. The inlet opening empties into a crusher space fashioned as a conical crusher with several crushing bars which are arranged, for one, on the hub of the central cutting wheel and, for another, on the inside of the tapered plate of the conical crusher.

Flushing and suction lines are provided for removal of the soil entering the crusher space.

The central cutting wheel of the center cutter features preferably a rim covering in the direction of advance an annular gap provided between the center cutter and the center cutter opening in the cutting wheel. In one embodiment of the invention, the central cutting wheel of the center cutter is provided with several inlet openings, on the rims of which there are shearing blades or other ripping tools provided. Specifically, it is possible to equip the central cutting wheel with several roller bits working in the direction of advance. Carbide tipping may be provided along the rim of the central cutting wheel of the center cutter.

BRIEF DESCRIPTION OF THE DRAWINGS

Two embodiments of the invention will be more fully described hereafter with the aid of the drawing, which shows in FIG. 1, the front shield area of the tunneling machine according to the invention, as a section with a cut-away partial view of the center cutter.

DETAILED DESCRIPTION OF THE INVENTION

Figure 1:
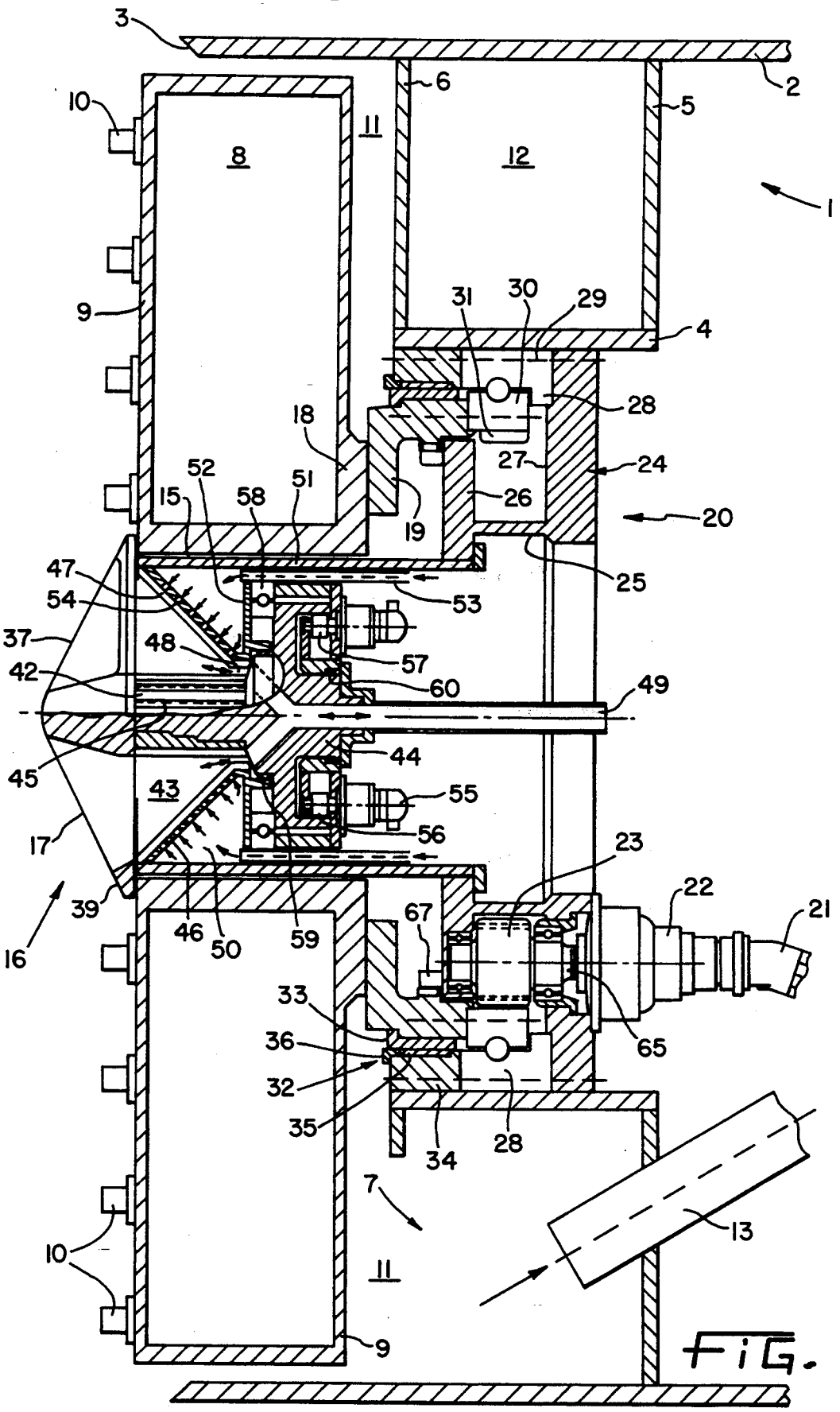

FIG. 1 depicts in longitudinal section a shield 1 provided on the front part of a tunneling, or tunnel boring machine. The shield 1 possesses a cylindrical shield shell 2 which on its front end pointing in the direction of advance is provided with a shield cutting edge 3. With FIG. 1 broken away toward the right, neither the tail of the shield 1 nor the remaining parts of the tunneling machine are shown in FIG. 1.

A center pipe 4 short in axial direction as compared to the shield shell 2 extends coaxially to the shield shell 2. On its right-hand end in FIG. 1, the center pipe 4 is fastened with the aid of a thrust wall 5 and, on its left-hand end in FIG. 1, with the aid of a plunge wall 6. Both the thrust wall 5 and the plunge wall 6 are ring-shaped, with the outside diameter of the ring corresponding to the inside diameter of the shield shell, the inside diameter of the ring to the outside diameter of the center pipe.

Figure 2:
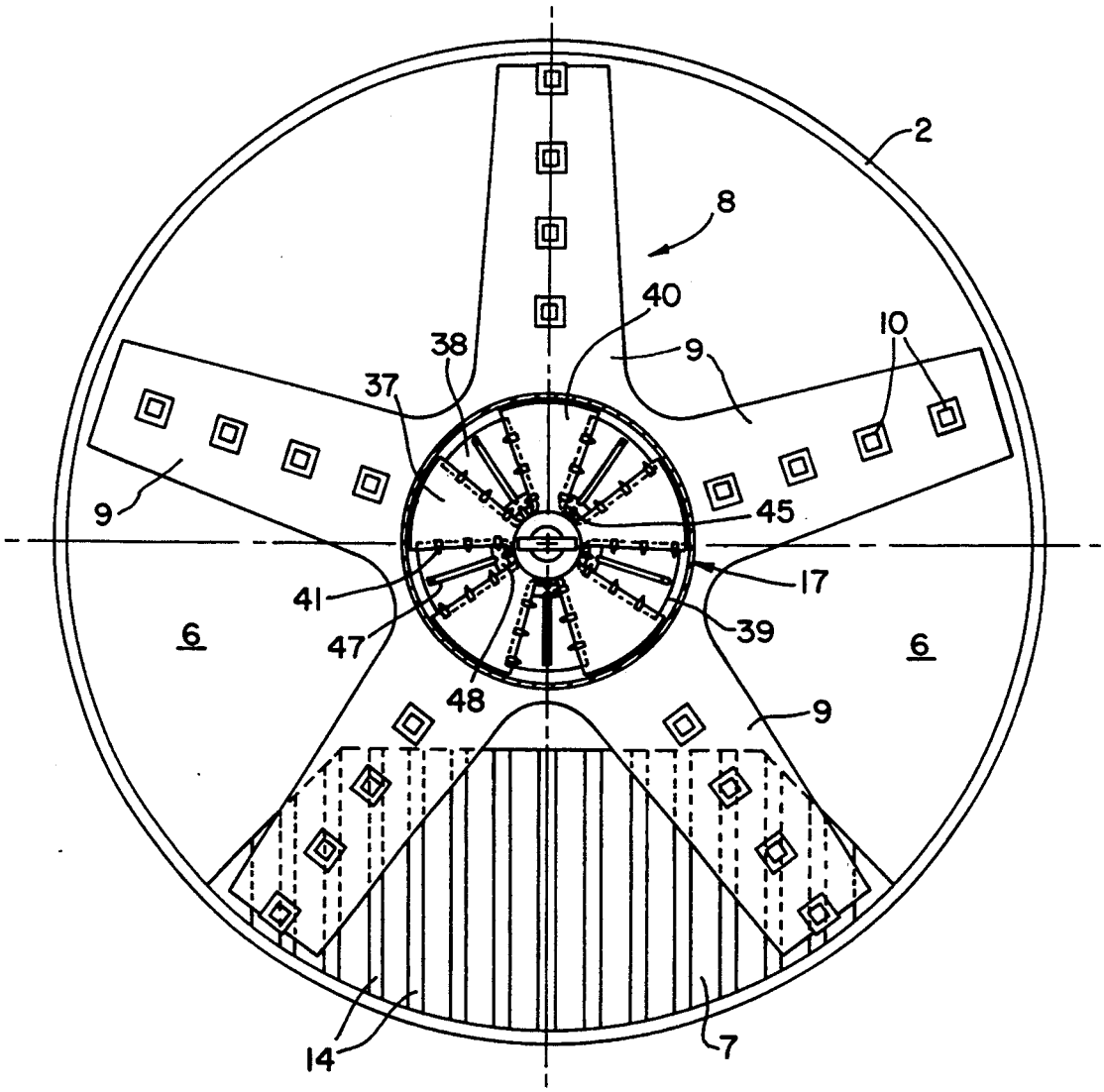
FIG. 2, a view of the tunneling machine according to FIG. 1, viewed against the direction of advance.

The plunge wall 6 is provided with a plunge wall opening 7 shown in FIG. 1, bottom, which FIG. 2 illustrates in front elevation.

FIG. 2 presents the previously mentioned shield shell 2 and the plunge wall 6, in front of which, in the direction of advance, an outer cutting wheel 8 illustrated in FIGS. 1 and 2 is arranged.

The cutting wheel 8 has several cutting arms 9. Those of the outer cutting wheel 8 are equipped each with several ripping tools 10 which in advancing the tunneling machine remove the soil in the area of the face, with the soil, mixed with water, proceeding into the extraction chamber 11 rearwardly defined by the plunge wall 6, and via the plunge wall opening 7 into the thrust chamber 12, whence the water-mixed soil is pumped with the aid of a centrifugal pump via a suction line 13 to a separating plant which, for instance, is located above ground. To avoid a clogging of the suction line 13, for instance the plunge wall opening 7 is provided with a grate composed of several bars 14.

The cutting wheel 8 possesses in the area of its hub a receiving opening 15 for accommodating a center cutter 16, fashioned for instance similar to a micromachine, with a central cutting wheel 17.

The outer cutting wheel 8, on its backside away from the ripping tools 10, is provided with a mounting flange 18 which nonrotationally is joined to a take-off flange 19. The latter is part of an outer cutting wheel drive mechanism 20 capable of powering the outer cutting wheel 8 both clockwise and counterclockwise. To that end there are several hydraulic or electric motors 21 provided, which by way of reduction gears accommodated in reduction gear casings 22 are coupled with drive pinions 23, of which one is illustrated in FIG. 1.

The drive pinion 23 is installed in the main gearbox housing 24 of the tunneling machine and connected, via a pinion shaft 65, with the reduction gear of the drive motor 21. The main gearbox housing 24 has a gearbox inner shell 25 fashioned as a short pipe section and extending between a ring-shaped annular, front gearbox wall 26 and a rear gearbox wall 27.

As can be seen from FIG. 1, the main gearbox housing 24 is mounted on the center pipe 4. A bearing 28 extends along the center pipe 4, with the bearing outer race 29 rigidly secured to the main gearbox housing 24, and the bearing inner race 30 to the take-off flange 19. The bearing inner race 30 has teeth 31 meshing with the teeth of the drive pinion 23.

To prevent material from the extraction chamber 11 from proceeding into the bearing 28, the take-off flange 19 is surrounded by a seal 32 which is comprised of a race 33, a packing carrier 34, packing 35 and a clamping ring 36. Additionally, an inner seal 67 is provided along the take-off flange 19 and the front gearbox housing wall 26.

Not illustrated in the drawing, a feed water line allows introducing water or a water suspension into the thrust chamber 12, so that it is filled constantly with liquid, for instance up to half of its height. The soil ripped with the aid of the outer cutting wheel 8 is removed via the suction line 13 with the aid of the liquid supplied through the water feed lines, as the cutting arms 9 are during the advance of the tunneling machine rotated clockwise or counterclockwise by means of drive motors 21.

To avoid a dead core formation in the hub area of the outer cutting wheel 8, the previously mentioned central cutting wheel 17 is provided, which FIG. 1 depicts as a cut-away partial view and a sectional view, and FIG. 2 as a plan view opposite to the direction of advance.

The central cutting wheel 17 of the center cutter 16 has a crowned end face 37 provided with several inlet openings 38. Depicted in FIG. 2, the inlet openings 38 extend in radial direction up to a rim 39. Wide spokes 40 are contained between the inlet openings 38.

As can be seen from FIG. 2, ripping tools 41, for instance shearing blades or round shank chisels, are provided along the inlet openings 38.

The central cutting wheel 17 has a hub 42 which extends into a cone-shaped crusher space 43 and is nonrotationally connected with a drive disk 44.

Along the hub 42, several inner crushing bars 45 extend inside the cone-shaped crusher space 43, the latter being surrounded by a conical plate 46 which is equipped with ā plurality of outer crushing bars 47. Formed thereby is a stone crusher for the soil penetrating through the inlet openings 38. FIG. 2 as well depicts the inner crushing bars 45 and the outer crushing bars 47.

Crushed in the conical crusher formed this way, the material leaves the crusher space 43 via the annular gap 48, which communicates with a flushing or suction line 49 extending through the drive disk 44.

The crusher space 43 is surrounded by a feed water distributing space 50 which in radial direction extends up to the housing shell 51 of the center cutter 16 and in axial direction up to a rear wall 52.

Provided in the rear wall 52 are several mouths of feed water lines 53, the feed water leaving the distributing space 50 through conduits 54, so that material contained in the crusher space 43 can be removed via the annular gap 48 and the flushing and suction line 49. The feed or suction line 49 can carry both liquid to the separating plant and feed water from the separating plant.

Several drive motors 55 for powering the central cutting wheel 17 are provided in the housing shell 51. As can be seen from FIG. 1, the drive disk 44 comprises a rim 56 with which pinions 57 of the drive motors 55 mesh. As can be seen further from FIG. 1, the drive disk 44 is installed by means of a bearing 58, with a front seal 59 and a rear seal 60 ensuring the necessary tightness. The rim 39 protruding beyond the annular gap remaining in the receiving opening 15 has a sealing effect as well.

Figure 3:
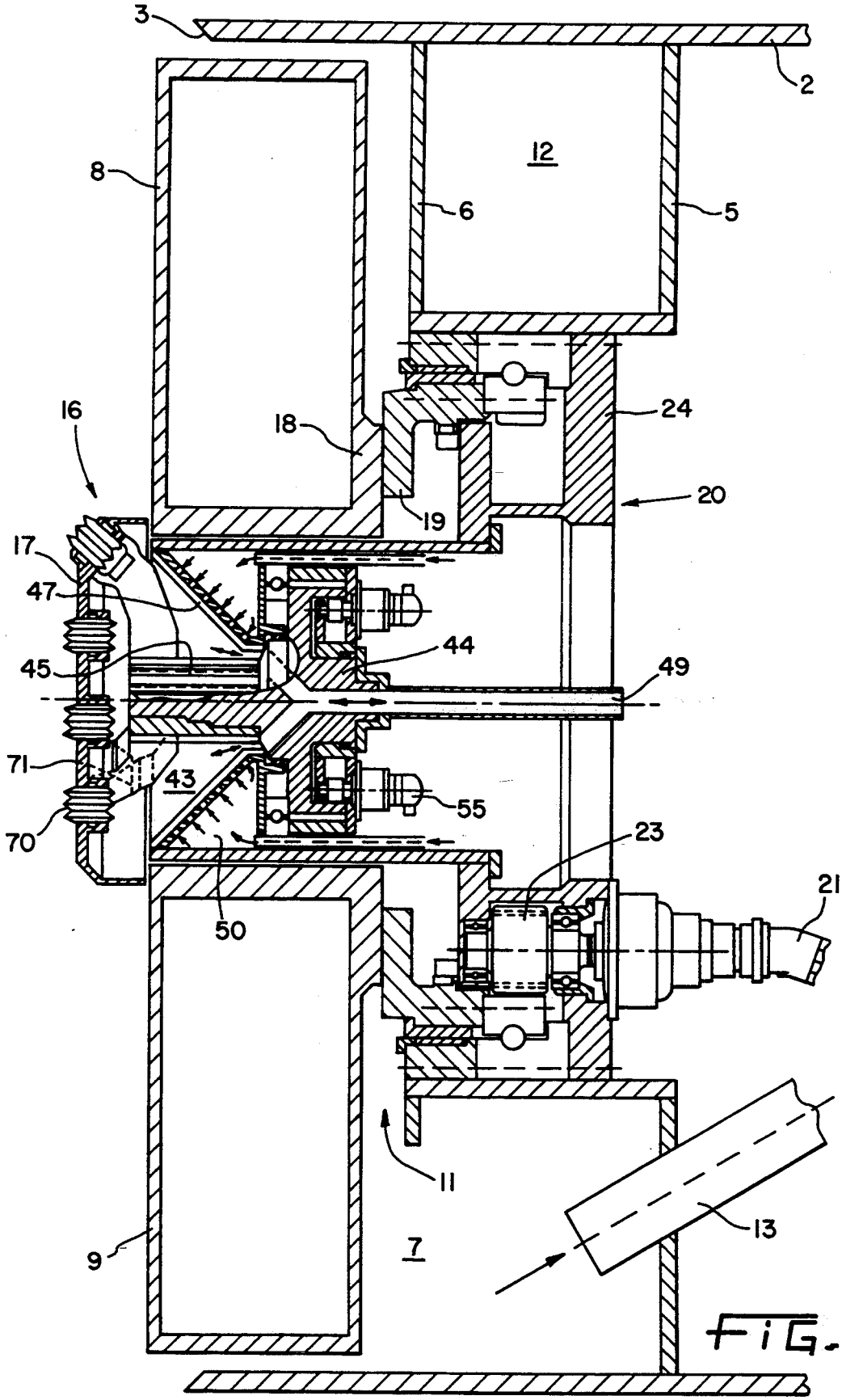
FIG. 3, an embodiment of the inventional tunneling machine modified relative to FIG. 1, with a center cutter featuring roller bits, and FIG. 4, a center cutter view corresponding to FIG. 3, scaled up somewhat as compared to FIGS. 2 and 3.

FIG. 3 shows the front part of a tunneling machine corresponding essentially to the structure shown in FIGS. 1 and 2, but with the central cutting wheel 17 provided with ripping tools other than shown in FIGS. 1 and 2. As follows from FIG. 3, the center cutter 16 shown there is equipped with roller bits 70 mounted on a disk-shaped tool carrier plate 71.

Figure 4:
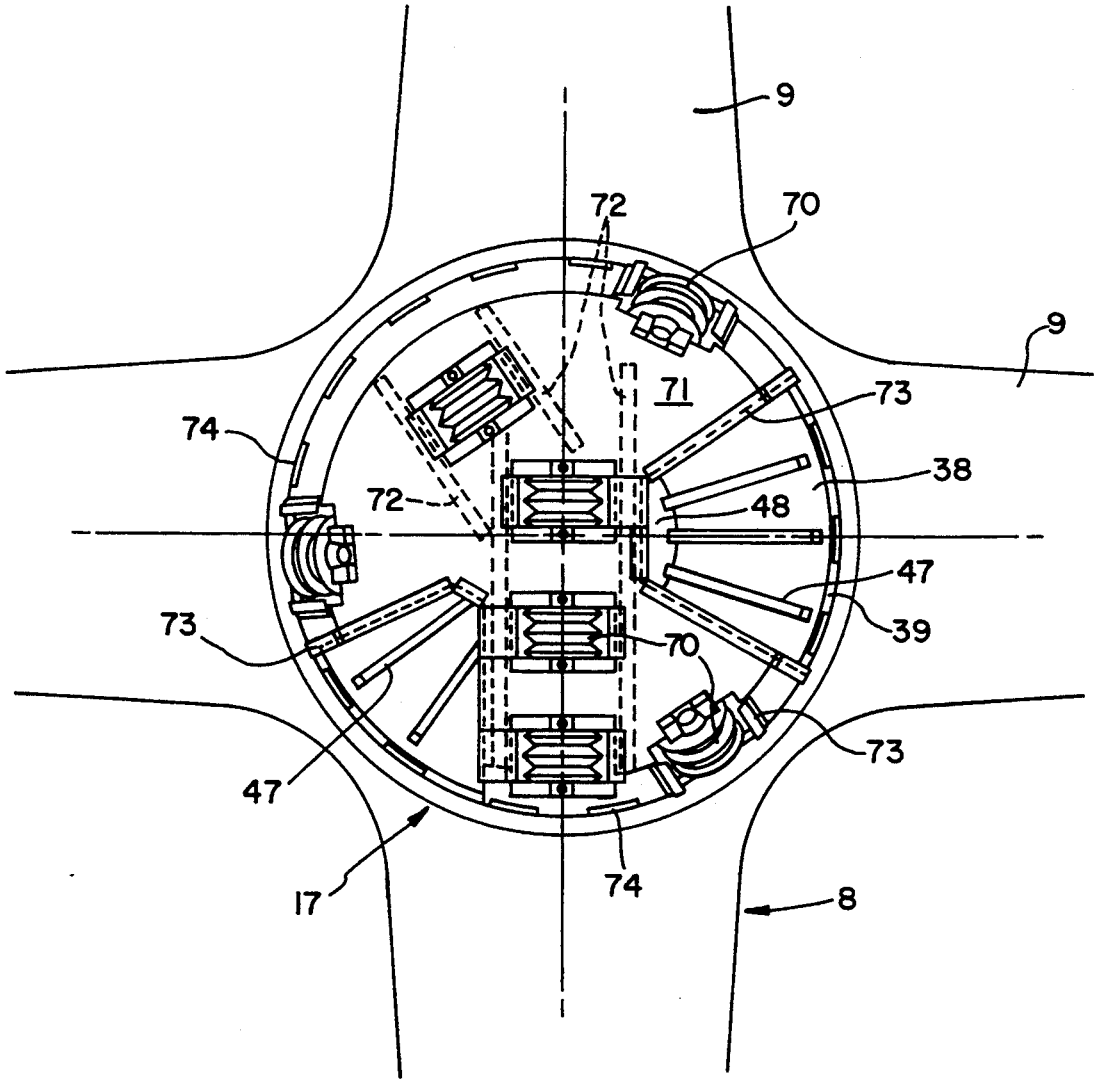

The tool carrier plate 71 is depicted in FIG. 4 in plan view. Additionally, FIG. 4 shows a number of reinforcement ribs 72 and scraper bars 73. Components matching those in FIG. 1 and 2 are referenced the same in FIGS. 3 and 4.

Also visible in FIG. 4 are a number of carbide tippings 74 along the periphery of rim 39 of the central cutting wheel 17.

What is claimed is:

1. A tunneling machine for boring a tunnel into soil, comprising:

a shield which is drivable into the said soil;

a rotatable cutting wheel disposed in said shield, said cutting wheel having a plurality of ripping tools and defining a hub area;

a crusher space;

a center cutter disposed in said hub area, said center cutter rotatable relative to said cutting wheel, said center cutter including a plurality of ripping tools for loosening the said soil, and a central cutting wheel, said central cutting wheel having at least one inlet opening for permitting entry of the said loosened soil into said crusher space; and a conduit connected to said crusher space to provide one of flushing action and suction action.

2. Tunneling machine according to claim 1, wherein said center cutter includes a drive mechanism separate from said rotatable cutting wheel for rotatably driving said center cutter in both directions of rotation.

3. Tunneling machine according to claim 1, wherein said central cutting wheel includes a hub and said crusher space comprises a conical crusher having a cone plate and a plurality of crushing bars, said crushing bars disposed on said hub and on an inside of said cone plate.

4. Tunneling machine according to claim 1, wherein the rotatable cutting wheel includes a receiving opening and said central cutting wheel includes a rim which in the direction of advance covers an annular gap provided for the center cutter and located between center cutter and said receiving opening.

5. Tunneling machine according to claim 4, further comprising carbide tippings provided along said rim.

6. Tunneling machine according to claim 1, including at least one shearing blade located at the edge of said one inlet opening.

7. Tunneling machine according to claim 1, wherein said central cutting wheel includes a plurality of roller bits which work in the direction of advance.

* * * * *